US008415894B2

(12) United States Patent
De Anna et al.

(10) Patent No.: US 8,415,894 B2
(45) Date of Patent: Apr. 9, 2013

(54) MULTIFUNCTIONAL OUTPUT STAGE FOR DRIVING DIMMED LIGHT SOURCES AND RELATED METHOD

(75) Inventors: Paolo De Anna, Vallà di Riese Pio X (IT); Michele Menegazzi, Paese (IT); Oskar Schallmoser, Ottobrun (DE); Nicola Zanforlin, Campodarsego (IT)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 12/809,075

(22) PCT Filed: Dec. 20, 2007

(86) PCT No.: PCT/IT2007/000895
§ 371 (c)(1),
(2), (4) Date: Sep. 10, 2010

(87) PCT Pub. No.: WO2009/081424
PCT Pub. Date: Jul. 2, 2009

(65) Prior Publication Data
US 2011/0006696 A1 Jan. 13, 2011

(51) Int. Cl.
*H05B 41/16* (2006.01)

(52) U.S. Cl. ..... 315/246; 315/291

(58) Field of Classification Search ..... 315/209 R, 315/210, 246, 291
See application file for complete search history.

(56) References Cited

U.S. PATENT DOCUMENTS

| | | | | |
|---|---|---|---|---|
| 7,492,108 | B2 | 2/2009 | Garcia et al. | |
| 7,804,256 | B2 * | 9/2010 | Melanson | 315/291 |
| 7,880,400 | B2 * | 2/2011 | Zhou et al. | 315/247 |
| 8,232,736 | B2 * | 7/2012 | Melanson | 315/247 |
| 2006/0071613 | A1 | 4/2006 | Lovato et al. | |

FOREIGN PATENT DOCUMENTS

| | | | |
|---|---|---|---|
| CN | 1720682 | A | 1/2006 |
| EP | 1912354 | A1 | 4/2008 |
| JP | 2009506522 | A | 2/2009 |
| WO | 0225842 | A2 | 3/2002 |
| WO | 2006123697 | A1 | 11/2006 |

OTHER PUBLICATIONS

International Search Report of PCT/IT2007/000895.

* cited by examiner

*Primary Examiner* — Thuy Vinh Tran

(57) ABSTRACT

A drive arrangement for light sources may include: a connection line to feed a light source, a switch element coupled to said line to apply on/off signals to said line, and a controller to control operation of said switch, said controller being sensitive to at least one of a dimming signal representative of a desired dimming level for said light source and an information-carrying digital signal, wherein said controller is configured to control operation of said switch to: a) PWM modulate an on/off signal applied to said line as a function of said dimming signal, whereby the average current conveyed towards said light source and determined by said PWM modulated on/off signal controls the brightness of said light source, b) transmit said information-carrying digital signal as an on/off information signal applied to said line, whereby the information carried by said information-carrying digital signal is transmitted over said line.

9 Claims, 3 Drawing Sheets

MULTIFUNCTIONAL OUTPUT STAGE FOR DRIVING DIMMED LIGHT SOURCES AND RELATED METHOD

RELATED APPLICATIONS

Figure 1:
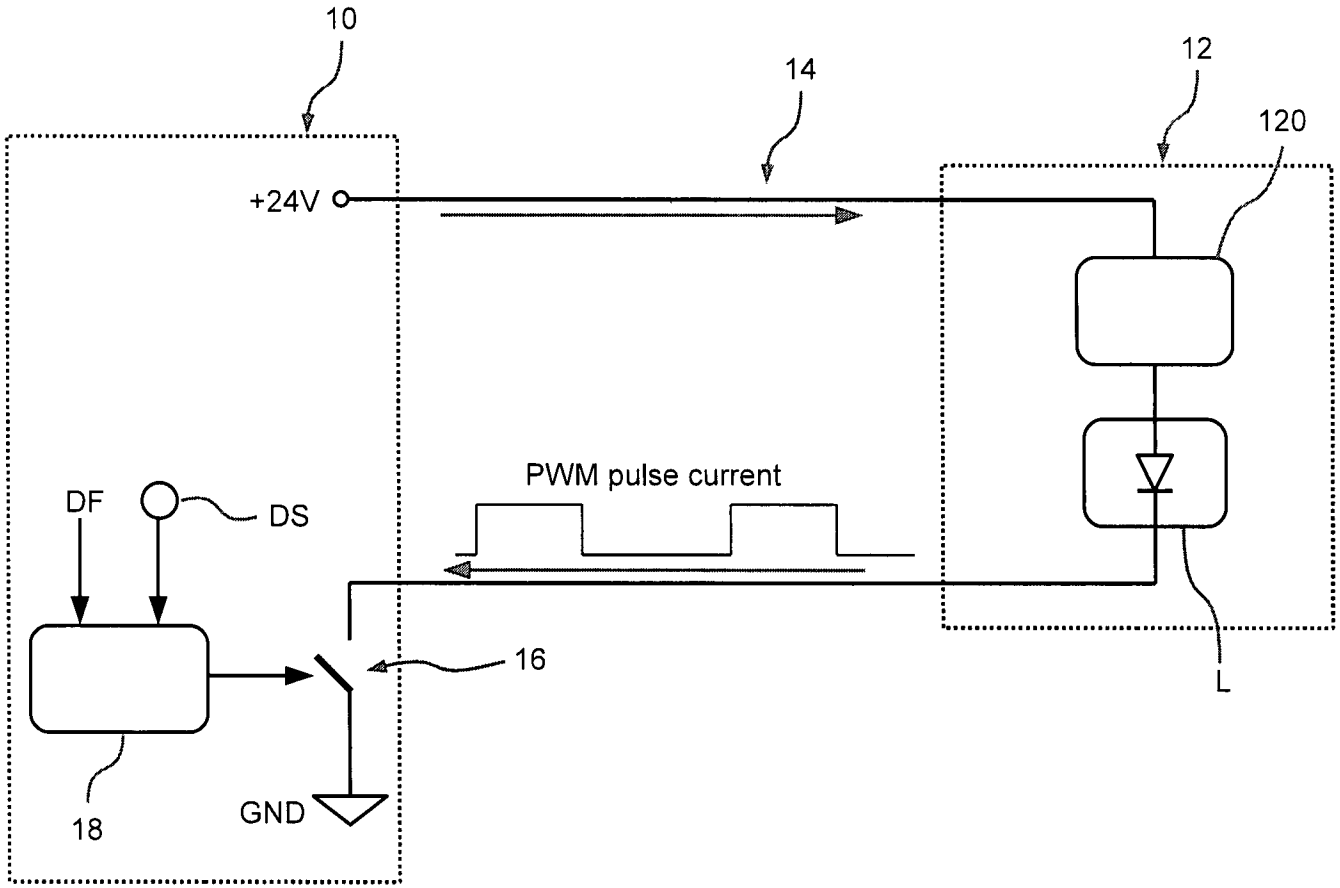

The present application is a national stage entry according to 35 U.S.C. §371 of PCT application No.: PCT/IT2007/000895 filed on Dec. 20, 2007.

FIELD OF THE INVENTION

The disclosure relates to output stages for driving dimmed light sources.

This disclosure was developed by paying specific attention to its possible use in driving light emitting diodes or LEDs. However, reference to this possible application is not to be construed in a limiting sense of the scope of the disclosure.

DESCRIPTION OF THE RELATED ART

A commonly adopted technique for dimming (i.e. changing the brightness of) light sources such as LEDs lighting devices is PWM (Pulse Width Modulation) low frequency power dimming. This technique is based on the recognition that the brightness of various types of light sources (LED lighting or illumination devices being a case in point) is related to the instant supplied to it; changing the current supplied to the light source is thus an effective way of adjusting the brightness thereof.

Dimming via PWM control basically involves periodically interrupting the current flow from a power supply to the light source with a variable duty cycle (i.e. the ratio of the "on" portion to the whole period of the signal). Different values of the PWM duty cycle lead to different values for the average current supplied to the light source. Another way of applying the same concept is to send towards the light source subject to dimming a constant powering signal along with a separate PWM signal which conveys the dimming information. In that case, the light source may be equipped with an electronic control module capable to "interpret" or "understand" the PWM signal and on/off switch the constant power supply to the light source to achieve the desired dimming effect.

OBJECT AND SUMMARY OF THE INVENTION

Within the context described in the foregoing, the need may exist of transmitting from the location of the power supply to the location of the light source digital information such as e.g. a digital serial frame data flow. This may be the case for e.g. light sources included in "smart" systems adapted to perform additional functions such as adjusting the relative brightness of differently coloured light sources in order to adjust the "colour temperature" of the resulting combined light.

A conventional approach to deal with that need may involve developing a dedicated output stage for each of the function considered (namely PWM dimming and digital signal transmission).

The object of the invention is to provide an improved arrangement dispensing with the need of providing such separate, dedicated output stages.

According to the present invention, that object is achieved by means of an output stage having the features set forth in the claims that follow.

The invention also relates to a corresponding method.

The claims are an integral part of the disclosure provided herein.

In an embodiment, by a proper use of an open drain/collector power output stage together with a proper control of the related gate, e.g. using a microcontroller, the same hardware output stage of a driver for a light source such as a LED can be used to implement any of the following functions:

i) PWM low frequency power dimming (brightness change) of the light source, ii) digital data transmission, e.g. serial frame transmission towards the light source, and iii) a combination of both functions i) and ii) above.

To sum up, the focus of the disclosure is on the possibility of using the same hardware device to implement PWM dimming (high current PWM pulses), serial digital transmission (digital frames) or both simultaneously.

BRIEF DESCRIPTION OF THE ANNEXED DRAWINGS

The invention will now be described, by way of example only, with reference to the annexed figures of drawing, including three figures designated FIGS. 1, 2, and 3. These figures are exemplary of three possible conditions of use of the arrangement disclosed herein.

DETAILED DESCRIPTION OF EXEMPLARY EMBODIMENTS

In the following description, numerous specific details are given to provide a thorough understanding of embodiments. The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

In the figures, references 10 and 12 designate the power supply side and the "load" side, respectively, of an arrangement for powering a light source such as e.g. one LED lighting module L including one or more LEDs, which may have associated current regulators 120 as needed.

As indicated, the disclosure is applicable also to any other type of light sources whose brightness is a function (e.g. proportional) of the instant current supplied thereto.

In the embodiment shown, the power supply 10 and the load 12 are connected via two-wire line 14.

In an embodiment, one of the wires of the line 14 is connected to a fixed, constant voltage level (for instance+24 Vcc). The other wire of the line 14 is coupled to a switch 16 adapted to selectively connect the associated wire of the line 14 to ground GND to apply an on/off signal to the line 14 (for instance, connection to the ground may be construed to mean "0" value while isolation from the ground may be construed to mean "1" or vice-versa).

In an embodiment, the switch 16 may be a semiconductor switch such a mosfet or, more generally, any known type of an open drain/collector power output stage having a control gate. The switch 16 may thus act under the action of a controller 18 such as a microcontroller (comprised of a single unit or separate units).

Reference SR denotes a serial bus receiver (of any known type) sensitive to the signal on the line 14. Specifically, when the signal on the line 14 is switched between a "0" level and a "1" level receiver SR is arranged in a known manner to understand such "0" and "1" levels as a digital signal transmitted over the line 14.

Figure 2:
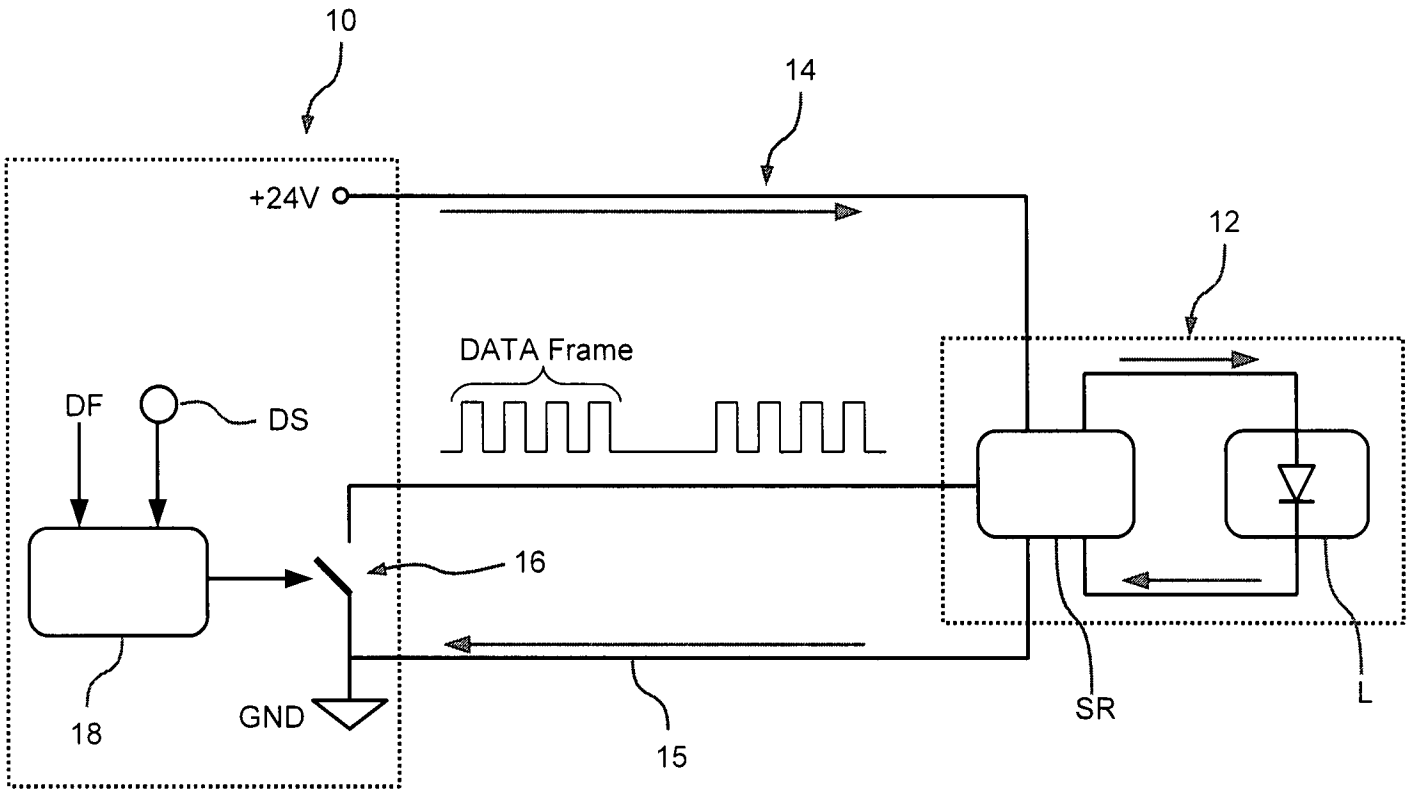
Figure 3:
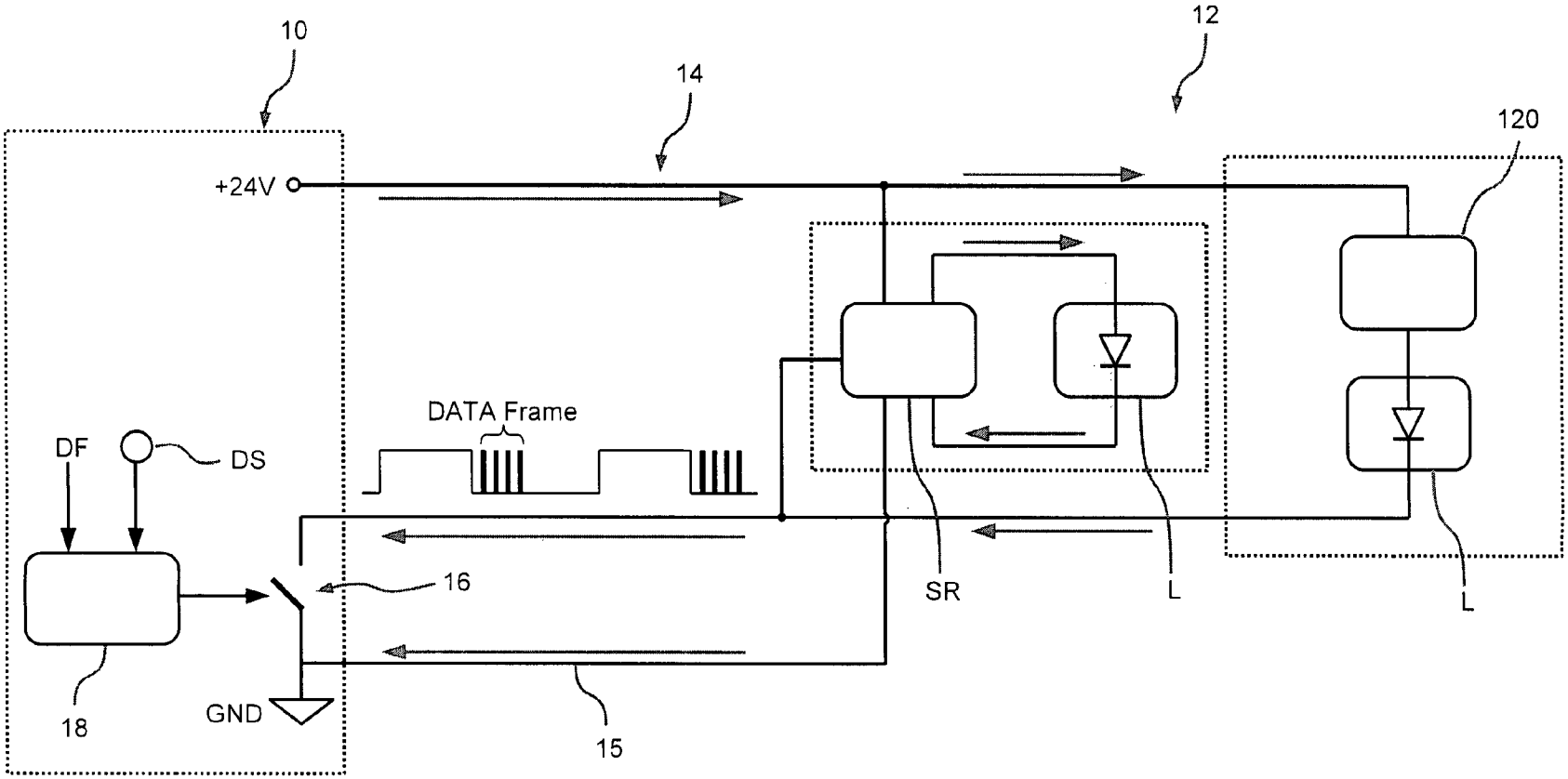

As shown in FIGS. 2 and 3, the serial bus receiver SR may in fact be associated with a LED L and thus also act as controlled current regulator for the associated LED. In the same figures, the line 14 is shown to include, an additional return line 15, whose function will be better detailed in the following.

In the embodiments illustrated, the microcontroller 18 is sensitive to at least two input signals, namely:

a dimming signal produced by a dimmer control DS of any known type, such as e.g. a slider manually actuatable by a user to indicate a desired degree or level of dimming for the light source L, and a digital signal such as e.g. data flow DF arranged in the form of digital serial frames.

When the signal is subjected to PWM modulation, that is switched between a "0" level and a "1" level with a duty cycle dictated by the power source 10, the brightness (i.e. the light intensity) produced by the source L will be a function of the average current associated with the PWM modulated signal.

As schematically shown in FIG. 1, when performing the dimming action, the controller 18 drives the switch 16 as a function of the dimming signal from the dimmer control DS. This results in selectively varying the duty cycle of the PWM modulated signal (PWM pulse current) sent as a high current flow over the line 14 towards the light source L. The details of performing this kind of operation are otherwise conventional and do not require a detailed description herein.

In another possible use for transmitting a digital signal (such as a data frame as shown in FIG. 2) the controller 18 will control switching on and off of the switch 16 in a way mirroring the digital signal DF in order to convey over the line 14 the information associated with the digital signal DF.

The digital signal conveyed over the line 14 is "read" by the receiver SR.

The digital (e.g. DATA Frame) signal sent over the line 14 may convey per se—any—kind of information.

In an embodiment (as illustrated in FIG. 2) the serial receiver SR is configured to act also as current regulator powered with constant powering signal applied between the e.g. 24V "hot" wire of the line 14 and the additional return line 15, which is connected to ground GND. In that case the digital signal sent over the line may convey towards the serial receiver/current regulator SR the dimming information, that is the information identifying the level of dimming to be applied to the LED L associated to the serial receiver/current regulator SR.

The serial receiver/current regulator SR will thus represent a module capable to "interpret" or "understand" the dimming information conveyed by the digital (e.g. DATA Frame) signal sent over the line 14 an correspondingly PWM on/off switch the constant power supply to the associated LED L to achieve the desired dimming effect.

As schematically shown in FIG. 3, the two functions (PWM dimming and digital data transmission) described in the foregoing in connection with FIGS. 1 and 2 can also be combined and performed simultaneously or in a substantially simultaneous manner.

In the exemplary embodiment shown, the digital signal (DATA frame) is transmitted over the line 14 during the "off" portions of the duty cycle of the PWM signal. In that way, the same structure is used both to PWM dim the light source L and to provide information over the line 14 by using the line 14 as a digital transmission line such as e.g. a serial bus.

Those of skill in the art will appreciate that in the case of combined PWM dimming digital transmission function, transmission of the digital signal (data frame) need not necessarily be limited to the "off" period of the PWM signal.

In fact, transmitting a digital signal over the line 14 amounts to transmitting power also toward the light source L. This may at least notionally affect the brightness level (i.e. the desired dimming level) of the light source L.

This effect can be easily minimized (and in fact dispensed with) by arranging the digital signals sent over the line 14 in the form of short, burst-like frames of short pulses (see e.g. FIG. 3), i.e. signals having a very small duty cycle, so that the power conveyed towards the light source L by the digital signal is in fact negligible and unable to alter the brightness level thereof.

Also, PWM dimming typically involves a low-frequency modulation of the signal over the line, while the digital signals sent over the line 14 will have a (much) higher repetition rate and may thus be easily filtered out before reaching the light source L.

An alternative approach may involve providing the controller 18 with a function (of a known type) adapted to detect the average current associated with the data flow DF and correspondingly adjust the PWM dimming action to take into account also the average conveyed by the digital signal transmitted over the line 14.

Without prejudice to the underlying principles of the invention, the details and embodiments may vary, even significantly, with respect to what has been described by way of example only, without departing from the scope of the invention as defined by the annexed claims.

The invention claimed is:

1. A drive arrangement for light sources including a power supply, said power supply comprising:

a two-wire connection line configured to feed at least one of an at least one first and second light source, wherein the first wire of said two-wire connection line is configured to be connected to a fixed, constant voltage level, and wherein the second wire of said two-wire connection line is configured to be coupled to at least one switch element adapted to selectively connect said second of said two-wire connection line to ground to apply on/off signals to said two-wire connection line, and a controller configured to control operation of said switch element, said controller being sensitive to a dimming signal representative of a desired dimming level for at least one of said at least one first and second light sources and an information-carrying digital signal, wherein said power supply further comprises:

a return line connected to ground, and wherein said power supply is configured to power:

said at least one first light source having associated a current regulator and being connected to said power supply via said two-wire connection line, and said at least one second light source having associated a serial bus receiver configured to act as a controlled current regulator powered with a constant powering signal applied between said one of said two-wire connection line and said additional return line connected to ground, wherein said serial bus receiver is sensitive to the signal on said two-wire connection line and arranged to understand said on/off signals as a digital signal transmitted over said two-wire connection line, and wherein said controller is configured to control operation of said switch to:

PWM modulate an on/off signal applied to said connection line as a function of said dimming signal by selectively varying the duty cycle of the PWM modulated signal sent as a high current flow over said two-wire connection line towards said at least one first and second light source, whereby the average current conveyed towards said at least one first and second light source and determined by said PWM modulated on/off signal controls the brightness of said at least one first and second light source having associated a current regulator and being connected to said power supply via said two-wire connection line, transmit said information-carrying digital signal as an on/off information signal applied to said connection line, whereby the information carried by said informationcarrying digital signal is transmitted over said two-wire connection line, whereby said digital signal conveys to said serial bus receiver the dimming information identifying the level of dimming to be applied to said at least one first and second light source associated with the respective serial bus driver.

2. The arrangement of claim 1, wherein said controller is configured to control operation of said switch to transmit said information-carrying digital signal as an on/off information signal applied to said two-wire connection line during the off portions of said PWM modulated on/off signal.

3. The arrangement of claim 1, wherein said controller is configured to control operation of said switch to transmit said information-carrying digital signal as short on/off pulses applied to said two-wire connection line.

4. The arrangement of claim 1 wherein said controller is configured to control operation of said switch to transmit said information-carrying digital signal as on/off pulses having a repetition rate higher than the modulation frequency of said PWM modulated on/off signal.

5. The arrangement of claim 1, further comprising: an at least one second light source having associated a serial bus receiver coupled with said two-wire connection line to sense on/off signals applied to said connection line and read the information carried by said information-carrying digital signal.

6. The arrangement of claim 5, wherein: said serial bus receiver is coupled to a current regulator for an associated light source, and wherein said serial bus receiver is configured to read the information carried by said information-carrying digital signal as representative of a desired dimming level for said associated light source and drive said current regulator coupled thereto to provide said desired dimming level for said associated light source.

7. The arrangement of claim 1, wherein at least one of said at least one first and second light source includes at least one LED.

8. The arrangement of claim 1, further comprising a light source having associated a current regulator and being connected to said power supply via said two-wire connection line, wherein the brightness produced by the light source is a function of the average current associated with said PWM modulated signal.

9. A method of driving at least one first and second light source via a two-wire connection line and a return line connected to ground, wherein the first wire of said two-wire connection line is connected to a fixed, constant voltage level, and wherein the second wire of said two-wire connection line is coupled to at least one switch element adapted to selectively connect said second wire of said two-wire connection to ground to apply to said connection line on/off signals directed to said at least one first and second light source, wherein said at least one first and second light source include:

said at least one first light source having associated a current regulator and being connected to said power supply via said two-wire connection line, and said at least one second light source having associated a serial bus receiver configured to act as a controlled current regulator powered with a constant powering signal applied between said one of said two-wire connection line and said additional return line connected to ground, wherein said serial bus receiver is sensitive to the signal on said two-wire connection line and arranged to understand said on/off signals as a digital signal transmitted over said two-wire connection line, the method comprising:

sensing a dimming signal representative of a desired dimming level for said at least one light source and an information-carrying digital signal, PWM modulating an on/off signal applied to said connection line as a function of said dimming signal by selectively varying the duty cycle of the PWM modulated signal sent as a high current flow over said two-wire connection line towards said at least one first and second light source, whereby the average current conveyed towards said at least one first and second light source and determined by said PWM modulated on/off signal controls the brightness of said at least one first and second light source having associated a current regulator and being connected to said power supply via said two-wire connection line, and transmitting said information-carrying digital signal as an on/off information signal applied to said connection line, whereby the information carried by said information-carrying digital signal is transmitted over said connection line, whereby said digital signal conveys to said serial bus receiver the dimming information identifying the level of dimming to be applied to the light sources associated with the respective serial bus receiver.

* * * * *